US010271418B2

(12) United States Patent
Abs et al.

(10) Patent No.: US 10,271,418 B2
(45) **Date of Patent: *Apr. 23, 2019**

(54) COMPACT ELECTRON ACCELERATOR COMPRISING PERMANENT MAGNETS

(71) Applicant: Ion Beam Applications S.A., Louvain-la-Neuve (BE)

(72) Inventors: Michel Abs, Bossière (BE); Willem Kleeven, Pellenberg (NL); Jarno Van De Walle, Denderleeuw (BE); Jérémy Brison, Woluwé St Lambert (BE); Denis Deschodt, Chastre (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

This patent is subject to a terminal disclaimer.

(21) Appl. No.: 15/805,509

(22) Filed: Nov. 7, 2017

(65) Prior Publication Data

US 2018/0132342 A1 May 10, 2018

(30) Foreign Application Priority Data

Nov. 7, 2016 (EP) ..... 16197603

(51) Int. Cl.
*H05H 7/04* (2006.01)
*H05H 7/18* (2006.01)
(Continued)

(52) U.S. Cl.
CPC ..... *H05H 7/04* (2013.01); *H05H 7/02* (2013.01); *H05H 7/08* (2013.01); *H05H 7/18* (2013.01);
(Continued)

(58) Field of Classification Search
None
See application file for complete search history.

(56) References Cited

U.S. PATENT DOCUMENTS 5,506,475 A * 4/1996 Alton ..... H01J 27/18 315/111.21
2018/0130568 A1* 5/2018 Abs ..... G21K 1/093

FOREIGN PATENT DOCUMENTS

EP 2509399 A1 10/2012
EP 2804451 A1 11/2014
(Continued)

OTHER PUBLICATIONS

European Search Report for International Application No. EP 16197603 from the European Patent Office, dated Apr. 20, 2017.
(Continued)

*Primary Examiner* — Dedei K Hammond
(74) *Attorney, Agent, or Firm* — Finnegan, Henderson, Farabow, Garrett & Dunner LLP

(57) ABSTRACT

An electron accelerator is provided. The electron accelerator comprises a resonant cavity comprising a hollow closed conductor, an electron source configured to inject a beam of electrons, and an RF system. The electron accelerator further comprises a magnet unit, comprising a deflecting magnet. The deflecting magnet is configured to generate a magnetic field in a deflecting chamber in fluid communication with the resonant cavity by a deflecting window. The magnetic field is configured to deflect an electron beam emerging out of the resonant cavity through the deflecting window along a first radial trajectory in the mid-plane (Pm) and to redirect the electron beam into the resonant cavity through the deflecting window towards the central axis along a second radial trajectory. The deflecting magnet is composed of first and second permanent magnets positioned on either side of the mid-plane (Pm).

20 Claims, 4 Drawing Sheets

(51) Int. Cl.

| | |
|---|---|
| ***H05H 13/10*** | (2006.01) |
| ***H05H 7/02*** | (2006.01) |
| ***H05H 7/08*** | (2006.01) |
| ***H05H 13/00*** | (2006.01) |

(52) U.S. Cl.
CPC ..... *H05H 13/00* (2013.01); *H05H 13/10* (2013.01); *H05H 2007/046* (2013.01); *H05H 2007/084* (2013.01); *H05H 2245/1225* (2013.01); *H05H 2277/14* (2013.01)

(56) References Cited

FOREIGN PATENT DOCUMENTS

| | | | | |
|---|---|---|---|---|
| FR | 2815810 | A1 | | 4/2002 |
| JP | 11214200 | A | * | 8/1999 |
| JP | 11214200 | A | * | 8/1999 |
| JP | H11214200 | A | | 8/1999 |

OTHER PUBLICATIONS

Holzbauer, Jeremiah P, "Superconducting Half Wave Resonator Design and Research," US Particle Accelerator School 2012, Jun. 1, 2012, XP055365591, Retrieved from the Internet: URL: http://uspas.fnal.gov/materials/12MSU/JPH_HWR_Design.pdf.

* cited by examiner

COMPACT ELECTRON ACCELERATOR COMPRISING PERMANENT MAGNETS

CROSS-REFERENCE TO RELATED PATENT APPLICATIONS

This application claims the benefit of a European Application No. EP 16197603.0, filed Nov. 7, 2016, which is hereby incorporated by reference in its entirety.

FIELD OF THE INVENTION

The exemplary embodiments of the present disclosure relate to an electron accelerator having a resonant cavity centred on a central axis, Zc, and creating an oscillating electric field used for accelerating electrons along several radial paths. An accelerator, commercially available from IBA Industrial and Sterilization Solutions, is an example of such electron accelerator. An electron accelerator according to the present embodiments can be more compact and may have lower power requirements than conventional accelerator. This allows for the first time to provide a mobile electron accelerator. The element constituting the electron accelerator may be designed to provide a more efficient and versatile fabrication.

DESCRIPTION OF PRIOR ART

Electron accelerators having a resonant cavity are well known in the art. For example, EP0359774 describes an electron accelerator comprising:

(a) a resonant cavity consisting of a hollow closed conductor comprising:
  - an outer wall comprising an outer cylindrical portion having a central axis, Zc, and having an inner surface forming an outer conductor section, and,
  - an inner wall enclosed within the outer wall and comprising an inner cylindrical portion having the central axis, Zc, and having an outer surface forming an inner conductor section,
  - the resonant cavity being symmetrical with respect to a mid-plane, Pm, normal to the central axis, Zc, and intersecting the outer cylindrical portion and inner cylindrical portion, (b) an electron source adapted for radially injecting an electron beam into the resonant cavity, from an introduction inlet opening on the outer conductor to the central axis, Zc, along the mid-plane, Pm, (c) an RF system coupled to the resonant cavity and adapted for generating an electric field, E, between the outer conductor and the inner conductor oscillating at a frequency ($f_{RF}$), to accelerate the electrons of the electron beam along radial trajectories in the mid-plane, Pm, extending from the outer conductor towards the inner conductor and from the inner conductor towards the outer conductor;

(d) a magnet system comprising several electromagnets adapted for deflecting the trajectories of the electron beam from one radial trajectory to a different radial trajectory, each in the mid-plane, Pm, and passing through the central axis, Zc, from the electron source to an electron beam outlet.

In the following, the terms "accelerator" and "electron accelerator" are used as synonyms for an "electron accelerator having a resonant cavity".

As shown on FIG. 1(*b*), the electrons of an electron beam may be accelerated along the diameter (two radii, 2R) of the resonant cavity by the electric field, E, generated by the RF system between the outer conductor section and inner conductor section and between the inner conductor section and outer conductor section. The oscillating electric field, E, can first accelerate electrons over the distance between the outer conductor section and inner conductor section. The polarity of the electric field may change when the electrons cross the area around the centre of the resonant cavity comprised within the inner cylindrical portion. This area around the centre of the resonant cavity may provide a shielding from the electric field to the electrons which continue their trajectory at a constant velocity. Then, the electrons may be accelerated again in the segment of their trajectory comprised between the inner conductor section and outer conductor section. The polarity of the electric field again may change when the electrons are deflected by an electromagnet. The process can then be repeated as often as necessary for the electron beam to reach a target energy where it is discharged out of the accelerator. The trajectory of the electrons in the mid-plane, Pm, thus has the shape of a flower (see FIG. 1(*b*)).

An acceleratorcan be combined to external equipment such as a beam line and a beam scanning system. An accelerator can be used for sterilization, polymer modification, pulp processing, cold pasteurization of food, detection and security purposes, etc.

Today, the known accelerators are of large size, have a high production cost, and require a high power source of energy to use them. They are designed for sitting at a fixed location and with predetermined configuration. Application of an electron beam at different locations requires drawing an additional beam line, with all additional costs and technical problems associated with.

There is a demand in the industry for smaller, more compact, versatile and lower cost accelerators consuming less energy and which are preferably mobile units. Smaller diameter resonant cavities, however, require a higher power for accelerating electrons over shorter distances which is detrimental to the energy consumption of such compact accelerators. Independent of the size of a accelerator, energy consumption can be reduced by alimenting the RF source and by accelerating electrons during a fraction only of the duty cycle of the rhodotron as described in EP2804451. Even thus, however, energy consumption is higher with smaller resonant cavities.

A resonant cavity with smaller diameter also has a smaller outer circumference which reduces the space available for connecting the electron source and all the electromagnets of the magnet system to the resonant cavity. The production of small compact accelerator is more complex and more expensive than conventional accelerators.

The exemplary embodiments of the present disclosure relate to a compact accelerator requiring low energy, which is mobile, and which is cost-effective to produce. These advantages are described in more details in the following sections.

SUMMARY OF THE INVENTION

In particular, the exemplary embodiments of the present disclosure concern an electron accelerator comprising a resonant cavity, an electron source, an RF system, and at least one magnet unit.

The resonant cavity may consist of a hollow closed conductor comprising:

an outer wall comprising an outer cylindrical portion having a central axis, Zc, and having an inner surface forming an outer conductor section (1*o*), and, an inner wall enclosed within the outer wall and comprising an inner cylindrical portion of central axis, Zc, and having an outer surface forming an inner conductor section (1*i*).

The resonant cavity may be symmetrical with respect to a mid-plane, Pm, normal to the central axis, Zc, and intersecting the outer cylindrical portion and inner cylindrical portion.

The electron source can be adapted for radially injecting a beam of electrons into the resonant cavity, from an introduction inlet opening on the outer conductor section to the central axis, Zc, along the mid-plane, Pm.

The RF system can be coupled to the resonant cavity and can be adapted for generating an electric field, E, between the outer conductor section and the inner conductor section, oscillating at a frequency ($f_{RF}$), to accelerate the electrons of the electron beam along radial trajectories in the mid-plane, Pm, extending from the outer conductor section towards the inner conductor section and from the inner conductor section towards the outer conductor section.

The at least one magnet unit may comprise a deflecting magnet composed of first and second permanent magnets positioned on either side of the mid-plane, Pm, and may be adapted for generating a magnetic field in a deflecting chamber in fluid communication with the resonant cavity by at least one deflecting window, the magnetic field being adapted for deflecting an electron beam emerging out of the resonant cavity through the at least one deflecting window along a first radial trajectory in the mid-plane, Pm, and to redirect the electron beam into the resonant cavity through the at least one deflecting window or through a second deflecting window towards the central axis along a second radial trajectory in the mid-plane, Pm, the second radial trajectory being different from the first radial trajectory.

Each of the first and second permanent magnets may preferably be formed by a number of discrete magnet elements, arranged side by side in an array parallel to the mid-plane, Pm, comprising one or more rows of discrete magnet elements and disposed on either side of the deflecting chamber with respect to the mid-plane, Pm. This may allow fine tuning of the magnetic field by addition or removal of one or several of such discrete magnet elements. Preferably, the discrete magnet elements may be in the shape of prisms such as rectangular cuboids, cubes or cylinders.

The magnet unit can further comprise first and second support elements each comprising a magnet surface supporting the discrete magnet elements, and a chamber surface separated from the magnet surface by a thickness of the support element. The chamber surface may form or be contiguous to a wall of the deflecting chamber. Preferably, the chamber surface and magnet surface of each of the first and second support elements may be planar and parallel to the mid-plane, Pm. Depending on the number of discrete elements required for creating a magnetic field of desired magnitude, the chamber surface of each of the first and second support elements may have a surface area smaller than the surface area of the magnet surface. In this case, each of the first and second support elements may preferably comprise a tapered surface remote from the resonant cavity and joining the magnet surface to the chamber surface.

The electron accelerator of the present disclosure may also comprise a tool for adding or removing discrete magnet elements to or from the magnet surfaces of the first and second support elements. The tool may comprise an elongated profile, preferably a L-profile or a C profile, for receiving a number of discrete magnet elements desired in a given row of the array, and an elongated pusher, slidingly mounted on the elongated profile, for pushing the discrete magnet elements along the elongated profile.

The magnet unit can also comprise a yoke holding the first and second support elements at their desired position. Preferably, the yoke may allow fine tuning the position of the first and second support elements.

In a preferred embodiment, the resonant cavity of the electron accelerator of the present disclosure is formed by:

a first half shell (11), having a cylindrical outer wall of inner radius, R, and of central axis, Zc, a second half shell (12), having a cylindrical outer wall of inner radius, R, and of central axis, Zc, and a central ring element (13) of inner radius, R, sandwiched at the level of the mid-plane, Pm, between the first and second half shells.

In this embodiment, the surface forming the outer conductor section can be formed by an inner surface of the cylindrical outer wall of the first and second half shells, and by an inner edge of the central ring element, which is preferably flush with the inner surfaces of both first and second half shells.

Each of the first and second half shells may comprise the cylindrical outer wall, a bottom lid, and a central pillar jutting out of the bottom lid. The electron accelerator can further comprise a central chamber sandwiched between the central pillars of the first and second half shells. The central chamber may further comprise a cylindrical peripheral wall of central axis, Zc, with openings radially aligned with corresponding deflecting windows and the introduction inlet opening. In a preferred embodiment, the surface forming the inner conductor section may be formed by an outer surface of the central pillars and by the peripheral wall of the central chamber sandwiched therebetween.

A portion of the central ring element may extend radially beyond an outer surface of the outer wall of both first and second half shells. This is advantageous in that the at least one magnet unit can thus be fitted onto said portion of the central ring element.

The deflecting chamber of the at least one magnet unit can be formed by a hollowed cavity in a thickness of the central ring element, with the deflecting window being formed at the inner edge of the central ring element, facing the centre of the central ring element.

In a preferred embodiment, an electron accelerator according to the present disclosure, may comprise N magnet units, with N>1, and the deflecting magnets of n magnet units are composed of first and second permanent magnets, with $1 \leq n \leq N$.

Preferably, the at least one magnet unit may form a magnetic field in the deflecting chamber comprised between 0.05 T and 1.3 T, preferably 0.1 T to 0.7 T.

DESCRIPTION OF THE DRAWINGS

These and further embodiments of the present disclosure will be explained in greater detail by way of example and with reference to the accompanying drawings.

The figures are not drawn to scale.

DETAILED DESCRIPTION

Rhodotron

Figure 1:
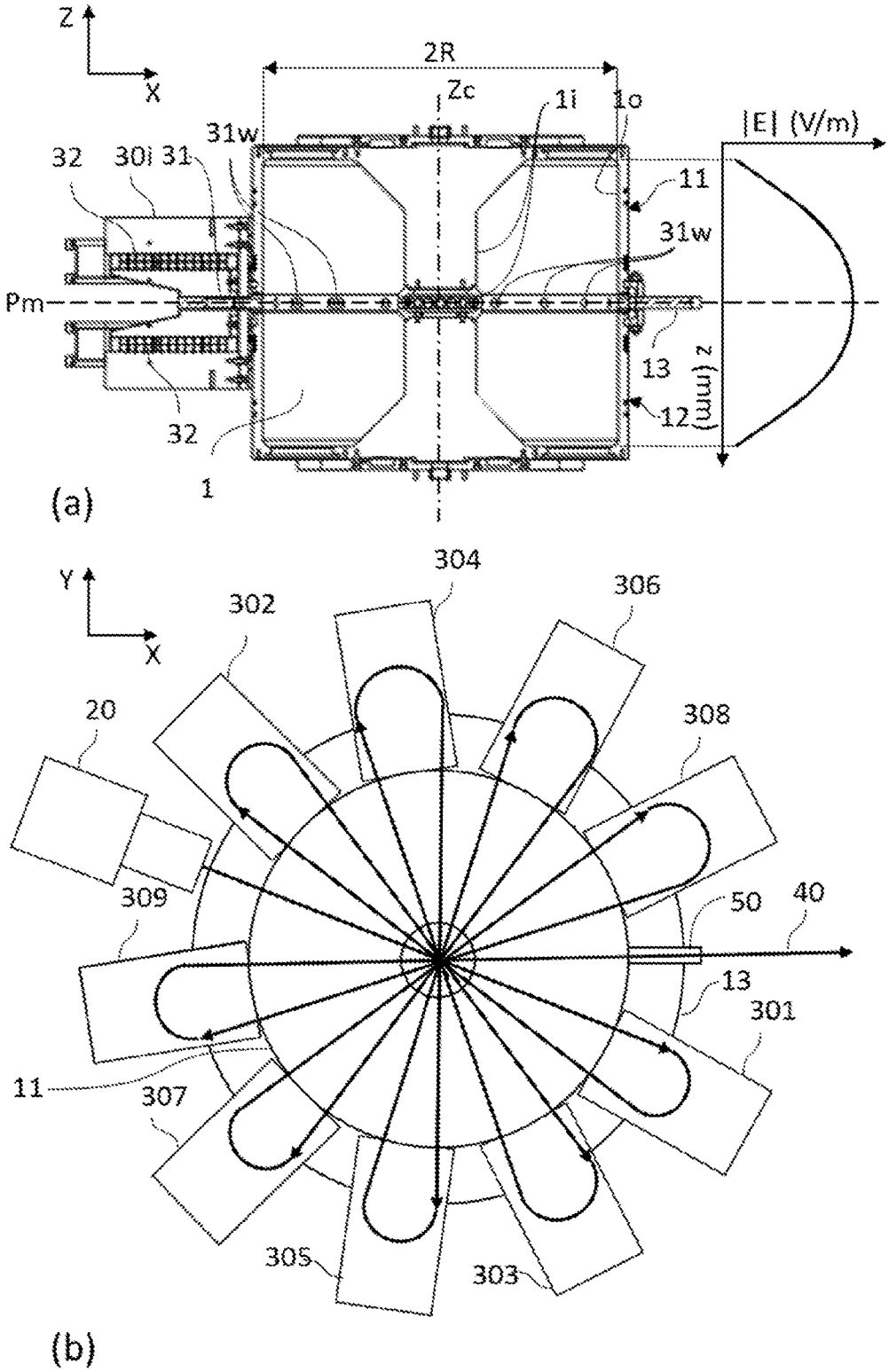
FIG. 1 schematically shows an exemplary embodiment of an electron accelerator according to the present disclosure, (a) a cut on a plane (X, Z), and (b) a view on a plane (X, Y), normal to (X, Z).
Figure 2:
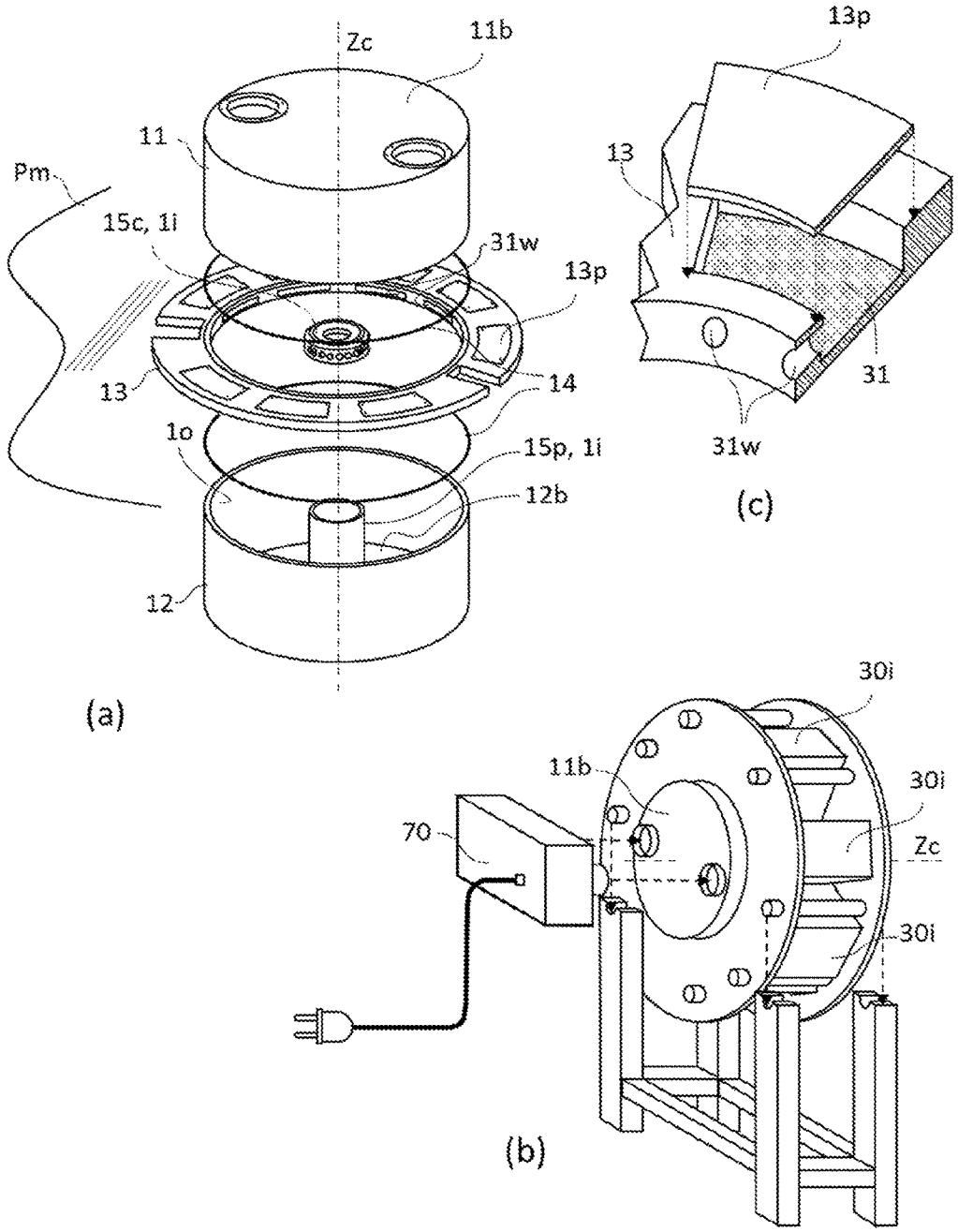
FIG. 2 schematically shows electron accelerator according to the present disclosure, (a) an exploded view of various elements of a preferred embodiment of the present disclosure, (b) ready for mounting on a stand for use and (c) an enlarged view of an embodiment of the central ring and deflecting chamber construction.

FIGS. 1 and 2 show an example of an accelerator according to the embodiments of the present disclosure comprising:

(a) a resonant cavity (1) comprising a hollow closed conductor;
(b) an electron source (20);
(c) a vacuum system (not shown);
(d) a RF system (70);
(e) a magnet system comprising at least one magnet unit (30*i*).

Resonant Cavity

The resonant cavity (1) may comprise:

(a) a central axis, Zc;
(b) an outer wall comprising an outer cylindrical portion coaxial to the central axis, Zc, and having an inner surface forming an outer conductor section (1*o*);
(c) an inner wall enclosed within the outer wall and comprising an inner cylindrical portion coaxial to the central axis, Zc, and having an outer surface forming an inner conductor section (1*i*);
(d) two bottom lids (11*b*, 12*b*) joining the outer wall and the inner wall, thus closing the resonant cavity; and
(e) a mid-plane, Pm, normal to the central axis, Zc, and intersecting the inner cylindrical portion and outer cylindrical portion. The intersection of the mid-plane and the central axis may define the centre of the resonant cavity.

The resonant cavity (1) may be divided into two symmetrical parts with respect to the mid-plane, Pm. This symmetry of the resonant cavity with respect to the mid-plane concerns the geometry of the resonant cavity and can ignore the presence of any openings, e.g., for connecting the RF system (70) or the vacuum system. The inner surface of the resonant cavity thus may form a hollow closed conductor in the shape of a toroidal volume.

The mid-plane, Pm, can be vertical, horizontal or have any suitable orientations with respect to the ground on which the rhodotron rests. In another embodiment, it is vertical.

The resonant cavity (1) may further comprise openings for connecting the RF system (70), and the vacuum system (not shown). These openings may preferably be made in at least one of the two bottom lids (11*b*, 12*b*).

The outer wall may further comprise openings intersected by the mid-plane, Pm. For example, the outer wall may comprise an introduction inlet opening for introducing an electron beam (40) in the resonant cavity (1). It may further comprise an electron beam outlet (50) for discharging out of the resonant cavity the electron beam (40) accelerated to a desired energy. Additionally, the outer wall may further comprise deflecting windows (31*w*), bringing in fluid communication the resonant cavity with corresponding deflecting chamber (31, see below). Generally, an accelerator may comprise several magnet units and several deflecting windows.

An accelerator can generally accelerate the electrons of an electron beam to energies which can be comprised between 1 and 50 MeV, preferably between 3 and MeV, more preferably between 5 and 10 MeV.

The inner wall may comprise openings radially aligned with corresponding deflecting windows (31*w*) permitting the passage of an electron beam through the inner cylindrical portion along a rectilinear radial trajectory.

The surface of the resonant cavity (1) comprising a hollow closed conductor can be made of a conductive material. For example, the conductive material can be one of gold, silver, platinum, aluminium, preferably copper. The outer and inner walls and bottom lids can be made of steel coated with a layer of conductive material.

The resonant cavity (1) may have a diameter, 2R, comprised between 0.3 m and 4 m, preferably between 0.4 m and 1.2 m, more preferably between 0.5 m and 0.7 m. The height of the resonant cavity (1), measured parallel to the central axis, Zc, can be comprised between 0.3 m and 4 m, preferably between 0.4 m and 1.2 m, more preferably between 0.5 m and 0.7 m.

The diameter of an accelerator including a resonant cavity (1), an electron source (20), a vacuum system, a RF system (70), and one or more magnet units, measured parallel to the mid-plane, Pm, may be comprised between 1 and 5 m, preferably between 1.2 and 2.8 m, more preferably between 1.4 and 1.8 m. The height of the accelerator measured parallel to the central axis, Zc, may be comprised between 0.5 and 5 m, preferably between 0.6 and 1.5 m, more preferably between 0.7 and 1.4 m.

Electron Source, Vacuum System, and RF System

The electron source (20) can be adapted for generating and for introducing an electron beam (40) into the resonant cavity along the mid-plane, Pm, towards the central axis, Zc, through an introduction inlet opening. For example, the electron source may be an electron gun. As well known by a person of ordinary skill in the art, an electron gun can be an electrical component that produces a narrow, collimated electron beam that has a precise kinetic energy.

The vacuum system may comprise a vacuum pump for pumping air out of the resonant cavity (1) and creating a vacuum therein.

The RF system (70) may be coupled to the resonant cavity (1) via a coupler and typically may comprise an oscillator designed for oscillating at a resonant frequency, $f_{RF}$, for generating an RF signal, followed by an amplifier or a chain of amplifiers for achieving a desired output power at the end of the chain. The RF system thus may generate a resonant radial electric field, E, in the resonant cavity. The resonant radial electric field, E, may oscillate such as to accelerate the electrons of the electron beam (40) along a trajectory lying in the mid-plane, Pm, from the outer conductor section towards the inner conductor section, and, subsequently, from the inner conductor section towards a deflecting window (31*w*). The resonant radial electric field, E, may generally be of the "TE001" type, for which the electric field may be transverse ("TE"), may have a symmetry of revolution (first "0"), may not be cancelled out along one radius of the cavity (second "0"), and may be a half-cycle of said field in a direction parallel to the central axis Z.

Magnet System

The magnet system may comprise at least one magnet unit (301) comprising a deflecting magnet composed of first and second permanent magnets (32) positioned on either side of the mid-plane, Pm, and adapted for generating a magnetic field in a deflecting chamber (31). The deflecting chamber may be in fluid communication with the resonant cavity (1) by at least one deflecting window (31*w*).

Preferably, the magnet system may comprise several magnet units (30*i* with i=1, 2, . . . N). N is equal to the total number of magnet units and is comprised between 1 and 15, preferably between 4 and 12, more preferably between 5 and 10. The number N of magnet units may correspond to (N+1) accelerations of the electrons of an electron beam (40) before it exits the accelerator with a given energy. For example, FIG. 4 in (a) shows accelerators comprising nine (9) magnet units (30*i*) producing a 10 MeV electron beam, whilst the accelerators in (b) comprise five (5) magnet units, producing a 6 MeV electron beam.

The electron beam may be injected in the resonant cavity by the electron source (20) through the introduction inlet opening along the mid-plane, Pm. It may follow a radial trajectory in the mid-plane, Pm, said trajectory crossing:

(a) the inner wall through a first opening;

(b) the centre of the resonant cavity (i.e. the central axis, Zc);

(c) the inner wall through a second opening;

(d) the outer wall through a first deflecting window (31*w*);

(e) a first deflecting chamber (31).

The electron beam may then be deflected by the deflecting magnet of the magnet unit (30*i*) and reintroduced into the resonant cavity through the first or a second deflecting window along a different radial trajectory. The electron beam can follow such path a number N of times until it reaches a target energy. The electron beam can then be extracted out of the resonant cavity through an electron beam outlet (50).

In the present disclosure, a radial trajectory can be defined as a rectilinear trajectory intersecting perpendicularly the central axis, Zc.

Permanent Magnets

While conventional accelerators use electro-magnets in the magnet units used for deflecting the trajectories of an electron beam back into the resonant cavity, an accelerator according to the present invention differs from such conventional accelerators in that the deflecting magnet of at least one magnet unit (30*i*) may be composed of first and second permanent magnets (32).

Figure 4:
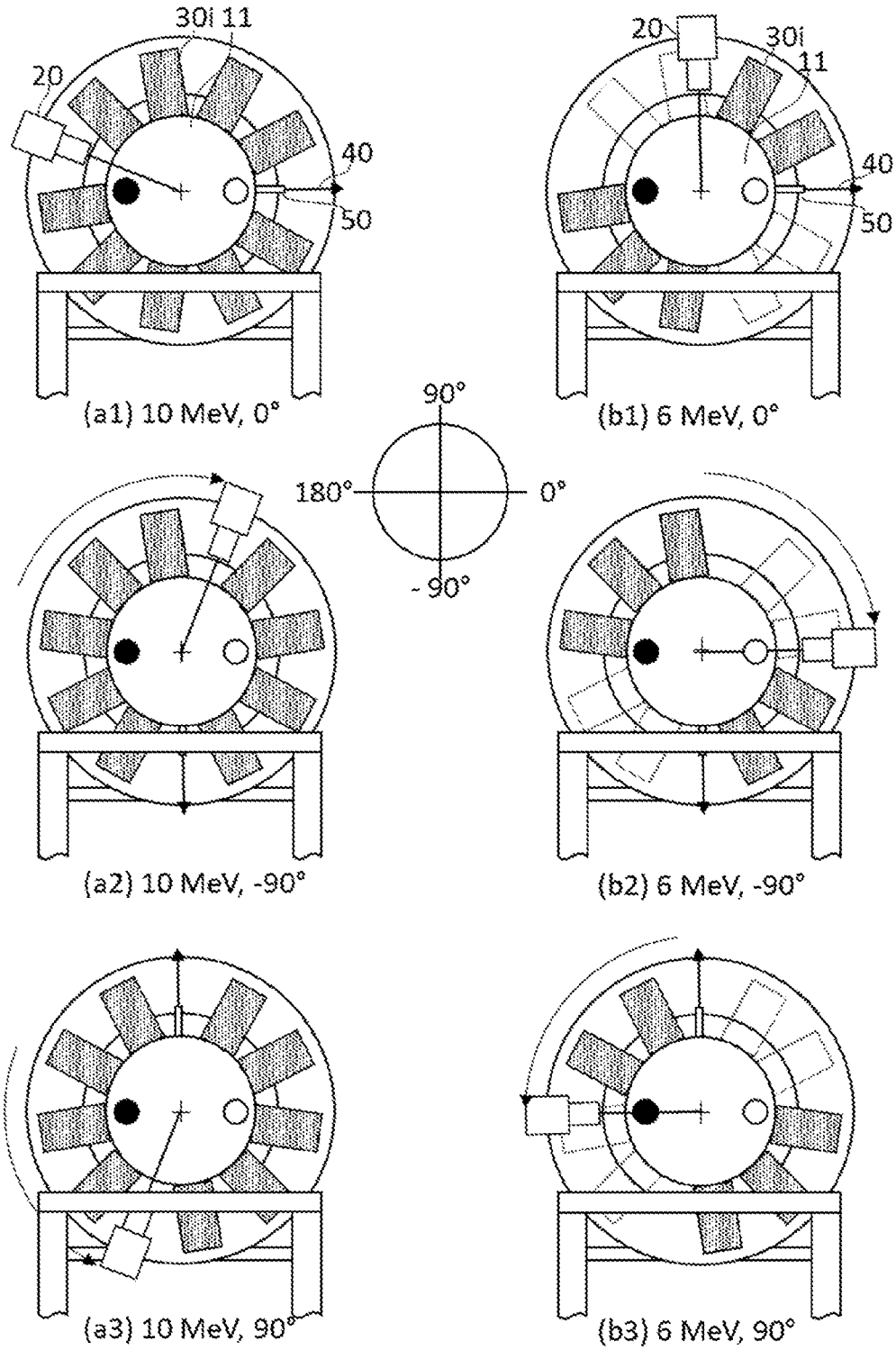
FIG. 4 shows how the direction of the electron beam extracted from an acceleratorcan be amended for an electron beam of (a) 10 MeV and (b) 6 MeV.

Generally, an accelerator may comprise more than one magnet unit (30*i*). In a preferred embodiment comprising a total of N magnet units, with N>1, n magnet units may comprise a deflecting magnet composed of first and second permanent magnets (32), with $1 \leq n \leq N$. For example, the accelerator illustrated in FIG. 4(*a*) may comprise N=9 magnet units, whilst the accelerator illustrated in FIG. 4(*b*) may comprise N=5 magnet units. In FIGS. 4(*a*)&(*b*), all the magnet units may comprise permanent magnets (n=N). An accelerator according to the present disclosure may require at least one of the N magnet units to comprise permanent magnets, so that one or more (N−n) magnet units of an accelerator can be electro-magnets. In practice, an accelerator can comprise for example one electro-magnet (i.e., n=N−1), or two electro-magnets (i.e., n=N−2), or three electro-magnets (i.e., n=N−3).

An accelerator preferably may comprise at most one electro-magnet. For example, the first magnet unit (301) located opposite the electron source (20) can differ from the other (N−1) magnet units, because the electron beam reaches said first magnet unit at a lower speed than the other magnet units. In order to return the electron beam into the resonant cavity in phase with the oscillating electric field, the deflection path in the first magnet unit may need to be slightly different from the (N−1) remaining magnet units. The first magnet unit (301) can therefore be an electro-magnet, allowing an easy fine tuning of the magnetic field generated in the corresponding deflection chamber (31).

Changing from conventional accelerators with all magnet units being equipped with electro-magnets to an accelerator according to the present disclosure wherein at least one magnet unit and preferably several magnet units may be equipped with permanent magnets may appear with hindsight to be an easy step, but this is not the case and a person of ordinary skill in the art would have a strong prejudice against taking such step for the following reasons. An accelerator is a very sophisticated piece of equipment, requiring accurate fine tuning to ensure that the electron beam follows the flower shaped path illustrated in FIG. 1(*b*). The RF-system and dimensions of the resonant cavity must ensure that an electric field oscillating at a desired frequency, $f_{RF}$, and of wavelength, $\lambda_{RF}$, be produced. In particular, the accelerator configuration must ensure that the distance, L, of a loop travelled by an electron from the central axis, Zc, to a magnet unit (30*i*) along a first radial trajectory, through the deflecting chamber (31), and back from the magnet unit (30*i*) to the central axis, Zc, along a second radial trajectory (i.e. one flower petal of the flower shaped path illustrated in FIG. 1(*b*))) is a multiple of the wavelength, $\lambda_{RF}$, of the electric field, $L=M\lambda_{RF}$, wherein M is an integer, preferably M is equal to 1, and thus $L=\lambda_{RF}$.

The radius of the circular path followed by the electron beam in the deflecting chamber may depend on the magnitude of the magnetic field created between the first and second permanent magnets (32) of the deflecting magnet. Fine tuning of said magnetic field in each and every magnet unit of the accelerator is essential to ensure that the electron beam follows the pre-established flower-shaped path in phase with the oscillating electric field. This can be achieved with an electro-magnet by controlling the current sent into the coils. Any deviation in the deflecting path of the electron beam at one magnet unit may be reproduced and amplified in the other magnet units, to a point that the final radial trajectory of the electron beam may be offset from the electron beam outlet (50) thus rendering the accelerator inoperable and dangerous.

A permanent magnet, by contrast, generates a given magnetic field which is intrinsic to the material used and can only be varied by changing the volume of the permanent magnet. A person of ordinary skill in the art therefore has a strong prejudice against using a permanent magnet for any of the magnet units of an accelerator, since fine tuning of the magnetic field in the deflecting chamber seems impossible, or at least much more difficult than with an electro-magnet. Chopping bits or pieces off a permanent magnet is not a viable option, as it lacks control and reproducibility. For this reason alone, it is not obvious to a person of ordinary skill in the art to replace an accelerator's magnet unit equipped with a deflecting magnet composed of first and second electro-magnets by a magnet unit equipped with a deflecting magnet composed of a first and a second permanent magnets (32), as fine tuning of the magnetic field for ensuring a proper functioning of the accelerator may not be achievable.

Figure 3:
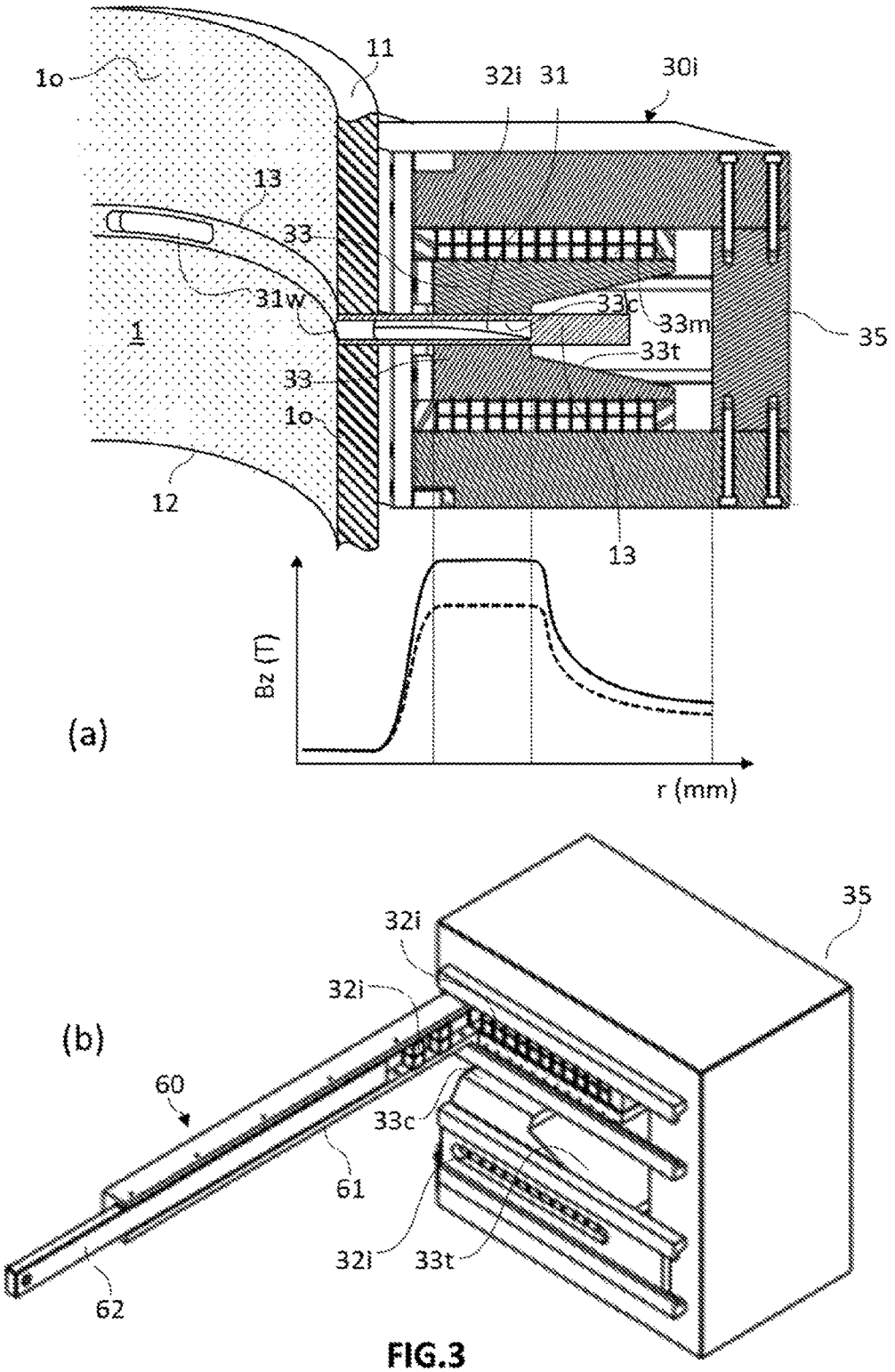
FIG. 3 shows an exemplary magnet unit used in a preferred embodiment of an accelerator according to the present disclosure (a) cut view along a plane (Z, r), with r being in the mid-plane, Pm and intersecting the central axis, Zc, and (b) a perspective view showing a tool for adding or removing discrete magnet elements to or from the magnet unit.

In the present invention, the deflecting magnet of at least one magnet unit (30*i*) may be composed of first and a second permanent magnets (32). The skilled person's prejudice of the absence of fine tuning the magnetic field in the deflecting chamber may be overcome in the present disclosure by the following preferred embodiment. As illustrated in FIG. 3, the magnetic field, Bz, in the deflecting chamber created by first and second permanent magnets can be fine-tuned by forming each of the first and second permanent magnets by arranging a number of discrete magnet elements (32*i*), side by side in an array parallel to the mid-plane, Pm. The array can be formed by one or more rows of discrete magnet elements. An array can be disposed on either side of the deflecting chamber with respect to the mid-plane, Pm. The discrete magnet elements can preferably be in the shape of prisms, such as rectangular cuboids, cubes or cylinders. Discrete rectangular cuboid magnet elements can be formed by two cubes stacked one on top of another and holding to one another by magnetic forces.

By varying the number of discrete magnet elements in each array, the magnetic field created in the deflecting chamber can be varied accordingly. For example, 12×12×12 mm cubes of an Nd—Fe—B permanent magnet material can be stacked two by two to form rectangular cuboid discrete magnet elements of dimensions 12×12×24 mm Other magnetic materials can be used instead, such as ferrite or Sm—Co permanent magnets. One such discrete magnet element disposed on opposite sides of the deflecting chamber can create a magnetic field of about 3.9 $10^{-3}$ Tesla (T) (=38.8 Gauss (G), with 1 G=$10^{-4}$ T). For a desired magnetic field, Bz, of about 0.6 T (=6060 G), 156 such discrete magnet elements may be needed on either side of the deflecting chamber. They can be arranged in 12×13 array. The magnetic field, Bz, in the deflecting chamber can thus be tuned by discrete steps of 3.9 $10^{-3}$/6 $10^{-1}$=0.6%, by adding or removing one by one discrete magnet elements into or from the arrays. The graph in FIG. 3(*a*) shows the magnetic field in a deflecting chamber along a radial direction, r, for two examples of numbers of rows of discrete elements disposed on either side of the deflecting chamber. The solid line shows a higher magnetic field created by a larger number of discrete magnet elements than the dashed line. The measurements show that a very constant magnetic field can be obtained over the whole deflecting chamber with permanent magnets formed, in particular, by discrete magnet elements, in accordance with the present disclosure.

With the essential fine tuning of the magnetic field in the individual deflecting chambers being made possible using permanent magnets made of arrays of discrete magnet elements, the use of permanent magnets may offer several advantages over the use of electro-magnets. First, the overall energy consumption of the accelerator can be reduced, since permanent magnets need not be powered. This is advantageous for mobile units, which are to be connected to energy sources with limited power capacity. As discussed supra, even by alimenting the RF source during a fraction only of the duty cycle of the accelerator as described in EP2804451, the power needs of an accelerator increases with decreasing diameter, 2R, of the resonant cavity. Using permanent magnets therefore contributes to decreasing the energy consumption of the accelerator.

Permanent magnets can be coupled directly against the outer wall of the resonant cavity, whilst the coils of electromagnets must be positioned at a distance of said outer wall. By allowing the magnet units to be directly adjacent to the outer wall, the construction of the accelerator can be greatly simplified and the production cost reduced accordingly as is described later with reference to FIGS. 2(*a*)&(*c*). Furthermore, permanent magnets do not require any electrical wiring, water cooling system, thermal insulation against overheating, nor any controller configured, for example, for adjusting the current or the flow of water. The absence of these elements coupled to the magnet units can also greatly reduce the production costs.

When during use, a conventional accelerator equipped with electromagnets undergoes a power cut, the electromagnets cease to generate a magnetic field, but a remnant magnetic field persists caused by all the ferromagnetic components of a magnet unit. When power is restored, the whole equipment needs calibration in order to produce the desired magnetic fields in each magnet unit. This is a delicate process. Power cuts may not happen very often in fixed installations, but they become recurrent with mobile units, plugged to electric installations of varying capacities and qualities.

As shown in FIG. 3(*a*), each magnet unit may comprise first and second support elements (33) each comprising a magnet surface (33*m*) supporting the discrete magnet elements, and a chamber surface (33*c*) separated from the magnet surface by a thickness of the support element. The chamber surface may form or be contiguous to a wall of the deflecting chamber. In FIG. 3(*a*) the chamber surfaces of the two support elements may be contiguous to first and second opposite walls of the deflecting chamber, which is formed as a cavity in a central ring element (13) as is discussed later with respect to FIG. 2(*a*). The first and second support elements may be made of a ferromagnetic material to drive the magnetic field from the first and second permanent magnets (32) formed of the discrete magnet elements (32*i*) as discussed supra. If the first and second support elements are contiguous to a first and second opposite walls of the deflecting chamber, the walls may be made of a ferromagnetic material too, for similar reasons.

The chamber surface and magnet surface of each of the first and second support elements may preferably be planar and parallel to the mid-plane, Pm. As shown in FIG. 3(*a*), the chamber surface of each of the first and second support elements may have a surface area smaller than the surface area of the magnet surface. This may happen if the number of rows required in arrays of discrete magnet elements for creating a magnetic field in the deflection chamber of for example 0.2 to 0.7 T (=2000 to 7000 G), extend in the radial direction further than the chamber area. This is not a problem as the magnetic field lines can be driven from the remotest portions of the magnet surface to the chamber surface through the first and second support elements along a tapered surface (33*t*) remote from the resonant cavity and joining the magnet surface to the chamber surface. These tapered surfaces of the first and second support elements can broaden the range of magnetic fields obtainable with discrete magnet elements, since the area of the magnet surfaces can thus be larger than the area of the chamber surfaces, while maintaining a homogeneous magnetic field in the deflection chamber.

For reasons of stability of the magnetic field, it is preferred to dimension the first and second support elements such as to reach saturation of the magnetic field in the support elements when they are loaded to their maximum capacity of discrete magnet elements.

The magnetic field required in the deflecting chamber may need to be sufficient for bending the trajectory of an electron beam exiting the resonant chamber along a radial trajectory through a deflecting window (31*w*) in an arc of circle of angle greater than 180° to drive it back into the resonant chamber along a second radial trajectory. For example, in an accelerator comprising nine (9) magnet units (30*i*) as illustrated in FIG. 1(*b*), the angle can be equal to 198°. The radius of the arc of circle can be of the order of 40 to 80 mm, preferably between 50 and 60 mm. The chamber surface may therefore need to have a length in a radial direction of the order of 65 to 80 mm. The magnetic field needed for bending an electron beam to such arcs of circle can be of the order of between 0.05 T and 1.3 T, preferably 0.1 T to 0.7 T, depending on the energy (velocity) of the electron beam to be deflected. As an illustrative example, using the discrete magnet elements of 12 mm width measured along a radial direction described supra, each creating a magnetic field of about 39 G (=3.9 $10^{-3}$ T), 156 discrete elements arranged in an array of 13 rows of 12 discrete magnet elements may be required on either side of the deflecting chamber for creating therein a magnetic field of 0.6 T. If each row is separated from its neighbouring rows by a distance of 1 mm, a length measured along a radial direction of at least 160 mm of the magnet surfaces may be required to support the 156 discrete magnet elements (=13 rows×12 mm+12 intervals×1 mm=160 mm). In this example, the length of the magnet surface can therefore be of the order of 2 to 2.3 times larger than the length of the chamber surface along a radial direction (=160/80 to 160/70=2 to 2.3).

The arrays of discrete magnet elements can therefore count a maximum number of rows comprised between 8 and 20 rows, preferably, between 10 and 15 rows, each row counting from 8 to 15 discrete magnet elements, preferably between 10 and 14 discrete magnet elements. With a higher number of discrete elements in each array, a finer tuning of the magnetic field, Bz, in the deflecting chamber can be performed.

Addition to or removal from a magnet surface of discrete magnet units can easily be performed with a tool specifically designed for this purpose. As illustrated in FIG. 3(*b*), the tool (60) may comprise an elongated profile (61). The elongated profile (61) may preferably be an L-profile or a C-profile, for receiving a number of discrete magnet elements desired in a given row of the array. An elongated pusher (62) may be slidingly mounted on the elongated profile for pushing the discrete magnet elements along the elongated profile. The tool, loaded with a desired number of discrete magnet elements may be positioned facing the row of the array where the discrete magnet elements are to be introduced. The discrete magnet elements may be pushed with the pusher along the row. When loading the discrete magnet elements on the elongated profile, they may repel each other and distribute themselves along the length of the elongated profile with a space separating them from one another. When pushing the discrete magnet elements with the elongated pusher, an initial resistance may need to be overcome, and then the discrete magnet elements may be literally sucked by the array and they align along the corresponding row contacting each other.

Removal of a row or of part of a row of discrete magnet elements from an array can be realized very easily with the tool (60) by positioning it at the level of the row to be removed and pushing with the elongated pusher along the row to push the discrete magnet elements out at the other side of the row. With the tool (60) the magnetic field in a deflecting chamber can easily be varied, and even fine-tuned, by removal or addition of individual discrete magnet elements, or of whole rows of discrete magnet elements. This can be done either in plant, by the equipment provider, or in situ by the end user.

In order to hold the elements of the magnet units in place, such as the first and second support elements and, in particular to ensure that the magnetic circuit of a magnet unit is closed, with magnetic lines forming closed loops, the magnet units may comprise a yoke (35), illustrated in FIG. 3. The yoke must be made of a ferromagnetic material to ensure the latter function, acting as a flux return. The yoke preferably may allow fine-tuning the position of the first and second support elements.

Modular Construction of the Electron Accelerator

As illustrated in FIG. 4, accelerators can be supplied in a number of different configurations. For example, different users may require accelerators to produce electron beams of different energies. The energy of the electron beam exiting an accelerator can be controlled by the number of radial accelerating trajectories followed by the electron beam before reaching an outlet (50), which depends on the number of active magnet units in the accelerator. The accelerators of FIG. 4(*a*) (=left column) may comprise nine (9) magnet units and may be configured to produce an electron beam of 10 MeV. The accelerators of FIG. 4(*b*) (=right column) may comprise five (5) magnet units and may be configured to produce an electron beam of 6 MeV. Different users may require an accelerated electron beam exiting the accelerator along a trajectory of a given orientation. The accelerators of FIGS. 4(*a*1)&4(*b*1) (=top line) may produce an electron beam exiting the accelerator horizontally (i.e., with an angle of 0°). The accelerators of FIGS. 4(*a*2)&4(*b*2) (=middle line) and of FIGS. 4(*a*3)&4(*b*3) (=bottom line) may produce an electron beam exiting the accelerator vertically, downwards (i.e., with an angle of −90° ) and upwards (i.e., with an angle of 90°), respectively.

Conventional accelerators are generally positioned "horizontally," i.e. with their mid-plane, Pm, being horizontal and parallel to the surface on which the accelerator rests. By rotating the accelerator about the (vertical) central axis, Zc, the electron beam outlet (50) can be directed in any direction along the mid-plane, Pm. It is not possible, however, to direct the electron beam outlet (50) out of the mid-plane (e.g., at 45° or vertically at 90° or 270° with respect to the mid-plane). Accelerators of the present embodiments are preferably positioned "vertically," i.e., with the central axis, Zc, being horizontal and parallel to the surface on which the accelerator rests and, consequently, the mid-plane, Pm, being vertical. An accelerator unit installed in a vertical orientation can have several advantages. First, it can lead to a decrease of the area on the ground occupied by the accelerator. This can reduce the room required for the installation of a accelerator unit to the point that mobile accelerator units can be installed in the cargo of a lorry. Second, the vertical orientation of an accelerator can allow directing the electron beam outlet (50) in any directions of the space. The accelerator can be rotated about the (horizontal) central axis, Zc, such as illustrated on FIG. 4, to reach any direction along the mid-plane, Pm, and it can be rotated about a vertical axis of the mid-plane, Pm, intersecting the central axis, Zc, to reach any direction in space. In order to reduce production costs, a novel set of modules or elements has been developed as described in continuation, allowing the production of accelerators with any orientations of the electron beam outlet with the same set of modules or elements. leading to a "clocking system" suitable for any direction of the electron beam outlet (50).

To date, two accelerators with different configurations require re-designing individually many parts of the accelerators, said parts having to be tailored and produced individually. As mentioned supra, the present embodiments propose a totally innovative concept, including a set of elements or modules common to accelerators of any configuration. Different configurations of accelerators can be obtained by modifying the assembly of the elements, and not the elements per se. This way, the number of tools and moulds required for the production of accelerators can be reduced substantially, thus reducing the production costs.

The modular construction of accelerators according to the exemplary embodiments of the present disclosure is illustrated in the exploded view of FIG. 2(*a*). The resonant cavity of a accelerators is formed by:

- a first half shell (11), having a cylindrical outer wall of inner radius, R, and of central axis, Zc,
- a second half shell (12), having a cylindrical outer wall of inner radius, R, and of central axis, Zc, and
- a central ring element (13) of inner radius, R, sandwiched at the level of the mid-plane, Pm, between the first and second half shells.

Referring to FIG. 2(*a*), each of the first and second half shells may comprise a cylindrical outer wall, a bottom lid (11*b*, 12*b*), and a central pillar (15*p*) jutting out of the bottom lid. A central chamber (15*c*) can be sandwiched between the central pillars of the first and second half shells.

As discussed supra, the resonant cavity can have a torus-like geometry of revolution. The whole inner surface of the resonant cavity can be made of a conductor material. In particular, the surface forming the outer conductor section (1*o*) can be formed by an inner surface of the cylindrical outer wall of the first and second half shells, and by an inner edge of the central ring element, which is preferably flush with the inner surfaces of both first and second half shells. The surface forming the inner conductor section (1*i*) can be formed by an outer surface of the central pillars and by the peripheral wall of the central chamber sandwiched therebetween.

As visible in FIGS. 2(*a*)&3(*a*), the central ring element (13) can have a first and second main surfaces separated from one another by a thickness thereof. A portion of the central ring element extends radially beyond an outer surface of the outer wall of both first and second half shells, forming a flange extending radially outwards. The magnet units (30*i*) can be mounted on and fitted onto said flange. The fit between the magnet units and the flange preferably affords some play for finely aligning the magnet units with the mid-plane, Pm, and the trajectory of the electron beam. In particular, the magnet units can preferably be tilted in a radial direction and translated along a direction parallel to the central axis, Zc, for positioning the magnet unit in perfect symmetry with respect to the mid-plane, and they can be translated parallel to the mid-plane, Pm, and rotated around an axis parallel to the central axis, Zc, for a perfect alignment with the electron beam trajectory.

In a preferred embodiment, the deflecting chamber (31) of at least one magnet unit can be formed by a hollowed cavity in the thickness of the central ring element, with the deflecting window (31*w*) being formed at the inner edge of the central ring element, facing the centre of the central ring element and the central axis, Zc. Preferably, several deflecting chambers, more preferably all the deflecting chambers of the accelerator can be formed by individual hollowed cavities in the thickness of the central ring element, with the corresponding deflecting windows being formed in the inner edge of the central ring element, facing the central axis, Zc. This construction can substantially reduce the production costs of accelerators compared to conventional designs for the following reasons.

Because electro-magnets may comprise coils between which a magnetic field is formed, they cannot be located directly adjacent to the outer wall of the resonant cavity. The deflecting chambers in conventional accelerators, provided with electro-magnets are therefore manufactured as individual components, which are coupled to the resonant cavity by means of two pipes, one aligned with the radial trajectory of the electron beam leaving the resonant cavity, the other aligned with the radial trajectory of the electron beam entering back into the resonant cavity. The two pipes may need to be coupled at one end to the magnet unit and at the other end to the outer wall of the resonant cavity. Coupling of the pipes can be performed by one or more of welding, screwing, riveting, and the like. An sealing O-ring may be used to ensure tightness of the coupling. This coupling operation can only be performed manually by a skilled artisan. It is time consuming, quite expensive, and not devoid or risks of misalignments of the different components (tubes, chamber, etc.).

By using permanent magnets, the magnet units can be located directly adjacent to the outer wall of the resonant cavity. By providing the deflecting chambers as hollowed cavities in the thickness of the central ring element, they can all be machined automatically accurately out of a single ring shaped plate. The magnet units can then be coupled to the central ring over each deflecting chamber thus formed. These operations can be much more accurate, reproducible, quick, and cost effective than coupling each individual magnet unit to the outer resonant cavity by means of two welded pipes, as discussed above.

The deflecting chambers (31) can be formed cost effectively as follows. As discussed supra, the central ring element can be made of a ring shaped plate comprising first and second main surfaces separated by a thickness of the ring shaped plate. As shown in FIGS. 2(*a*)&(*c*), each cavity forming a deflecting chamber can be produced by forming a recess open at the first main surface and at the inner edge of the ring shaped plate. The recess can be formed by machining, water jet cutting, laser ablation, or any other technique known in the art. A cover plate (13*p*) can then be coupled to the first main surface to seal the recess and form a cavity opened only at the inner edge to form one or more deflecting windows. A sealing ring can be used to seal the interface between the central ring element and the cover plate. The cover plate can be fixed by welding or by means of screws or rivets.

FIG. 2(*a*) shows a central ring element (13) provided with eight (8) deflecting chambers, closed on the first main surface by cover plates (13*p*) and opening at the inner edge of the central ring element with a single elongated deflecting window (13*w*) per deflecting chamber. The single elongated window may need to extend in the circumferential direction at least to encompass the trajectories of the electron beam leaving and entering back into the resonant cavity.

In an alternative embodiment illustrated in FIG. 2(*c*), each deflecting chamber may open at the inner edge with two smaller deflecting windows instead of a single large deflecting window as in the foregoing embodiment. A first deflecting window may be aligned with a radial exit-trajectory of the electron beam leaving the resonant cavity, and a second deflecting window may be aligned with a radial entry-trajectory of the electron beam entering back into the resonant cavity downstream of the circular trajectory of angle greater than 180° followed by the electron beam in the deflecting chamber. With these designs, multiple deflecting cavities can be formed in a single or few, automated operations, with deflecting windows (13*w*) in perfect and reproducible alignment with the desired radial trajectories of the electron beam.

For further rationalizing the production of an accelerator, it is preferred that the first and second half shells have an identical geometry and are each coupled to the central ring element with sealing means (14) to ensure tightness of the resonant cavity. Half sells can thus be produced in series, regardless of whether they will form a first or a second half shell of the resonant cavity. Beside the cylindrical outer wall already mentioned, each of the first and second half shells can comprise a bottom lid (11*b*, 12*b*), and a central pillar (15*p*) jutting out of the bottom lid. The inner conductor section (1*i*) can be formed by the first and second pillars contacting when the first and second half shells are coupled on either side of the central ring element. Alternatively, as shown in FIG. 2(*a*), a central chamber (15*c*) can be sandwiched between the central pillars of the first and second half shells. The central chamber may comprise a cylindrical peripheral wall of central axis, Zc. With or without central chamber, openings can be radially distributed on the peripheral wall of the central chamber or of the first and second pillars, in alignment with corresponding deflecting windows, the introduction inlet opening, and the electron beam outlet (50). The surface forming the inner conductor section can thus be formed by an outer surface of the central pillars and, if a central chamber is used, by the peripheral wall of the central chamber sandwiched therebetween.

With the modules described above, a resonant cavity can be formed by assembling the second half shell (12) to the central ring element (13), by means well known in the art, such as bolts, rivets, welding, soldering. The formed assembly can be assembled to the first half shell with the central chamber sandwiched between the first and second pillars, to complete the resonant cavity provided with an introduction inlet opening, an electron beam outlet (50), and with a number of deflecting windows (31*w*) in fluid communication with deflecting chambers, and in radial alignment with corresponding openings in the cylindrical wall of the central chamber. With a portion of the central ring element (13) forming a flange extending radially outwards and enclosing the deflecting chambers, the magnet units can be coupled to said flange at the corresponding positions of the deflecting chambers. No electrical wiring may be required in the produced assembly, since the permanent magnets need not be powered. This can considerably reduce the cost of production and the cost of use.

The first half shell may comprise at least one opening for coupling to the RF system (70). If, as shown in FIG. 2(*b*), said at least one opening is offset from the central axis, Zc, the angular position of the first half shell may be set by the position of such opening with respect to the RF system. The obtained assembly can be further stabilized by sandwiching it between two plates as shown in FIG. 2(*b*), firmly holding the magnet units in place. The whole can then be positioned into a stand. The RF system (70) can be coupled to the openings in the bottom lid of the first half shell. Only the RF system may need power to function since, unlike electromagnets, permanent magnets need not be powered. All the electrical wiring may therefore be concentrated in the RF system which can be produced separately as standard units. This is advantageous for the production, but also can make it easier to produce a mobile accelerator unit, requiring fewer power connections.

The various accelerator's configurations illustrated in FIG. 4 were discussed above, showing how the configurations of an accelerator can vary depending on the applications in terms of energy and orientation of the electron beam (40). With the modular construction described above, all configurations can be obtained with the same set of modules or elements. The white central circles in the accelerators of FIG. 4 may represent the bottom lid (11*b*) of the first half shell. The bottom lid (11*b*) may be provided with two openings for coupling an RF system which orientation is fixed and cannot be varied. The openings are illustrated in FIG. 4 with a black circle on the left hand side and a white circle on the right hand side, showing that in all configurations, the angular orientation of the first half shell may be maintained fixed.

For a given energy of the electron beam produced by the accelerator (e.g., MeV in the accelerators of FIGS. 4(*a*1-3) and 6 MeV in the accelerators of FIG. 4(*a*1-3)), the angular orientation of the outlet (50) can be varied by varying the angular orientation of the central ring element (13) and, optionally, of the second half shell with respect to the first half shell, which position may need to remain fixed.

For a given electron beam orientation (e.g., 0° in FIGS. 4(*a*1)&(*b*1), −90° in FIGS. 4(*a*2)&(*b*2), and 90° in FIGS. 4(*a*3)&(*b*3)), the energy of the electron beam can be varied by varying the number of activated magnet units. This can be achieved by simply removing or adding a number of magnet units or, alternatively, by removing or loading discrete magnet elements from or into a number of magnet units. The shaded magnet units (30*i*) in FIG. 4(*b*) represent active magnet units, whilst the white boxes, with dotted outlines represent inactive magnet units. The outlet (50) can easily be rotated by providing a canal branching out radially in each deflecting chamber. In the absence of a magnetic field for bending the radial trajectory of an electron beam, the latter can continue its radial trajectory through such canal and out of the accelerator.

All the different configurations illustrated in FIG. 4 can be achieved with a single set of modules illustrated in FIG. 2(*a*), while with conventional accelerators, each new configuration would require a new re-designing of the components, with assembling which is specific to each new configuration. Such rationalization of the production of accelerators with a single set of components may permit a drastic reduction in production costs and, at the same time, a higher reproducibility and reliability of the thus produced accelerators.

It may now be possible to produce mobile accelerators, of relatively small dimensions, requiring fewer power connections. Such mobile accelerator can be loaded in a lorry and transported where it is needed. The lorry can also carry a power generator to be totally autonomous.

| REF # | Feature |
|---|---|
| 1 i | inner conductor |
| 1 o | outer conductor |
| 1 | resonant cavity |
| 11 | first half shell |
| 11 b | bottom lid of first half shell |
| 12 | second half shell |
| 12 b | bottom lid of second half shell |
| 13 | central ring |
| 13 p | cover plate |
| 14 | sealing O-ring |
| 20 | electron source |
| 30 1 . . . | individual magnet unit |
| 30 i | magnet unit (in general) |
| 31 w | deflecting window |
| 31 | deflecting chamber |
| 32 i | discrete magnet element |
| 32 | permanent magnet |
| 33 c | chamber surface |
| 33 m | magnet surface |
| 33 | support element |
| 35 | yoke of magnet unit |
| 40 | electron beam |
| 50 | electron beam outlet |
| 60 | tool for adding or removing magnet elements |

-continued

| REF # | Feature |
|---|---|
| 61 | elongated profile of tool |
| 62 | elongated pusher of tool |
| 70 | RF system |

The invention claimed is:

1. An electron accelerator comprising:

a resonant cavity comprising a hollow closed conductor, wherein:

the conductor comprises an outer wall having an outer cylindrical portion of a central axis and an inner surface forming an outer conductor section;

the conductor comprises an inner wall enclosed within the outer wall and having an inner cylindrical portion of the central axis and an outer surface forming an inner conductor section; and the resonant cavity is symmetrical with respect to a mid-plane normal to the central axis and intersects the outer cylindrical portion and inner cylindrical portion;

an electron source configured to radially inject a first beam of electrons into the resonant cavity from an introduction inlet opening on the outer conductor section to the central axis along the mid-plane;

an RF system coupled to the resonant cavity and configured to generate an electric field between the outer conductor section and the inner conductor section, the electric field oscillating at a frequency so as to accelerate electrons of the first beam of electrons along radial trajectories in the mid-plane extending from the outer conductor section towards the inner conductor section and from the inner conductor section towards the outer conductor section, a magnet unit comprising a deflecting magnet configured to generate a magnetic field in a deflecting chamber in fluid communication with the resonant cavity by a first deflecting window, the magnetic field being configured to deflect a second electron beam emerging out of the resonant cavity through the first deflecting window along a first radial trajectory in the mid-plane and to redirect the second electron beam into the resonant cavity through one of the first deflecting window or a second deflecting window towards the central axis along a second radial trajectory in the mid-plane, the second radial trajectory being different from the first radial trajectory, wherein:

the deflecting magnet is composed of first and second permanent magnets positioned on either side of the mid-plane.

2. The electron accelerator of claim 1, wherein:

the first and second permanent magnets are each formed by a plurality of discrete magnet elements; and the magnet elements are arranged side-by-side in an array parallel to the mid-plane, the array comprising rows of magnet elements and disposed on either side of the deflecting chamber with respect to the mid-plane.

3. The electron accelerator of claim 2, wherein the magnet elements are in a shape of prisms, and wherein the shape of prisms includes at least one of rectangular cuboids, cubes, or cylinders.

4. The electron accelerator of claim 2, further comprising first and second support elements each comprising a magnet surface supporting the magnet elements; and a chamber surface separated from the magnet surface by a thickness of the first and second support elements, wherein:

the chamber surface is contiguous to a wall of the deflecting chamber.

5. The electron accelerator of claim 4, wherein the chamber surface and magnet surface of each of the first and second support elements are planar and parallel to the mid-plane.

6. The electron accelerator of claim 5, wherein:

the chamber surface of each of the first and second support elements has a surface area smaller than a surface area of the magnet surface; and each of the first and second support elements further comprises a tapered surface remote from the resonant cavity and joining the magnet surface to the chamber surface.

7. The electron accelerator of claim 4, further comprising a tool configured to modify the number of discrete magnet elements with respect to the magnet surfaces of the first and second support elements, wherein the tool further comprises:

at least one of an elongated L-profile or a C-profile for receiving a plurality of the magnet elements desired in a given row of the array; and an elongated pusher slidingly mounted on the elongated profile for pushing the magnet elements along the elongated profile.

8. The electron accelerator of claim 4, further comprising a yoke configured to hold the first and second support elements at their desired position and configured to provide fine-tuning of the position of the first and second support elements.

9. The electron accelerator of claim 1, wherein:

the resonant cavity is formed by a first half shell, a second half shell, and a central ring element;

the first half shell further comprises a cylindrical outer wall having an inner radius and a central axis;

the second half shell further comprises a cylindrical outer wall having an inner radius and a central axis;

the central ring element further comprises an inner radius sandwiched at the level of the mid-plane between the first and second half shells; and the surface forming the outer conductor section is formed by an inner surface of the cylindrical outer wall of the first and second half shells, and by an inner edge of the central ring element, which is preferably flush with the inner surfaces of both first and second half shells.

10. The electron accelerator of claim 9, wherein:

each of the first and second half shells further comprises the cylindrical outer wall, a bottom lid, and a central pillar extending from the bottom lid;

a central chamber is sandwiched between the central pillars of the first and second half shells, the central chamber comprising a cylindrical peripheral wall of central axis with openings radially aligned with corresponding first and second deflecting windows and the introduction inlet opening; and the surface forming the inner conductor section is formed by an outer surface of the central pillars and by the peripheral wall of the central chamber sandwiched therebetween.

11. The electron accelerator of claim 9, wherein:

a portion of the central ring element extends radially beyond an outer surface of the outer wall of both first and second half shells; and the magnet unit is fitted onto the portion of the central ring element.

12. The electron accelerator of claim 11, wherein:

the deflecting chamber of the magnet unit comprises a hollowed cavity in a thickness of the central ring element; and the first and second deflecting windows are formed at the inner edge of the central ring element, facing the center of the central ring element.

13. The electron accelerator of claim 1, further comprising N magnet units, wherein:

N is greater than 1;

the deflecting magnets of n magnet units are composed of first and second permanent magnets; and n is between 1 and N.

14. The electron accelerator of claim 1, wherein:

the magnet unit forms a magnetic field in the deflecting chamber; and the magnetic field is between 0.05 T and 1.3 T.

15. The electron accelerator of claim 14, wherein the magnetic field is between 0.1 T and 0.7 T.

16. A method of accelerating electrons, the method comprising:

providing a resonant cavity comprising a hollow closed conductor, wherein:

the conductor further comprises an outer wall having an outer cylindrical portion of a central axis and an inner surface forming an outer conductor section;

the conductor further comprises an inner wall enclosed within the outer wall and having an inner cylindrical portion of the central axis and an outer surface forming an inner conductor section; and the resonant cavity is symmetrical with respect to a mid-plane normal to the central axis and intersects the outer cylindrical portion and inner cylindrical portion;

radially injecting, by an electron source, a first beam of electrons into the resonant cavity from an introduction inlet opening on the outer conductor section to the central axis along the mid-plane;

generating, by an RF system coupled to the resonant cavity, an electric field between the outer conductor section and the inner conductor section, the electric field oscillating at a frequency and to accelerating electrons of the first beam of electrons along radial trajectories in the mid-plane, the trajectories extending from the outer conductor section towards the inner conductor section and from the inner conductor section towards the outer conductor section; and generating, by a magnetic unit comprising a deflecting magnet, a magnetic field in a deflecting chamber in fluid communication with the resonant cavity by a first deflecting window, the magnetic field configured to deflect a second electron beam emerging out of the resonant cavity through the first deflecting window along a first radial trajectory in the mid-plane and to redirect the second electron beam into the resonant cavity through one of the first deflecting window or a second deflecting window towards the central axis along a second radial trajectory in the mid-plane, the second radial trajectory being different from the first radial trajectory;

wherein the deflecting magnet is composed of first and second permanent magnets positioned on either side of the mid-plane.

17. The method of claim 16, wherein:

the first and second permanent magnets are each formed by a number of discrete magnet elements; and the number of discrete magnet elements are arranged side by side in an array parallel to the mid-plane comprising rows of discrete magnet elements and disposed on either side of the deflecting chamber with respect to the mid-plane.

18. The method of claim 17, further comprising coupling first and second support elements to the magnetic unit, the first and second support elements each comprising a magnet surface supporting the discrete magnet elements; and forming a chamber surface separated from the magnet surface by a thickness of the first and second support elements;

wherein the chamber surface is contiguous to a wall of the deflecting chamber.

19. The method of claim 16, further comprising:

providing a plurality of magnet units and a plurality of deflecting magnets comprising first and second permanent magnets;

wherein:

a number of magnet units and a number of deflecting magnets are greater than 1, and the number of magnet unit is greater than the number of deflecting magnets.

20. The method of claim 16, wherein the at least one magnet unit forms a magnetic field in the deflecting chamber between 0.05 T and 1.3 T.

* * * * *